US007406954B2

(12) United States Patent
Breuer et al.

(10) Patent No.: US 7,406,954 B2
(45) Date of Patent: Aug. 5, 2008

(54) FUEL PUMP CHECK VALVE

(75) Inventors: Todd Breuer, Fairfield, IL (US); Robert Gardner, Fairfield, IL (US)

(73) Assignee: Airtex Products, Fairfield, IL (US)

( * ) Notice: Subject to any disclaimer, the term of this patent is extended or adjusted under 35 U.S.C. 154(b) by 79 days.

(21) Appl. No.: 11/502,093

(22) Filed: Aug. 10, 2006

(65) Prior Publication Data

US 2008/0047531 A1 Feb. 28, 2008

(51) Int. Cl.
*F02M 37/00* (2006.01)

(52) U.S. Cl. ..... 123/510; 123/516; 137/511

(58) Field of Classification Search ..... 123/497, 123/502, 506, 510, 511, 516, 528, 446, 447, 123/457, 467; 137/528, 536, 537, 542
See application file for complete search history.

(56) References Cited

U.S. PATENT DOCUMENTS

| | | | | | |
|---|---|---|---|---|---|
| 2,909,192 | A | * | 10/1959 | Dobrick | 137/542 |
| 3,036,594 | A | * | 5/1962 | Salisbury | 137/536 |
| 3,356,103 | A | * | 12/1967 | Biello et al. | 137/515.5 |
| 4,502,954 | A | | 3/1985 | Druffel | |
| 4,639,202 | A | | 1/1987 | Mahanay et al. | |
| 4,964,391 | A | * | 10/1990 | Hoover | 123/510 |
| 4,978,282 | A | | 12/1990 | Fu et al. | |
| 5,145,348 | A | | 9/1992 | Zumbusch | |
| 5,413,077 | A | | 5/1995 | Hornby et al. | |
| 5,477,829 | A | | 12/1995 | Hassinger et al. | |
| 5,613,476 | A | | 3/1997 | Oi et al. | |
| 5,673,670 | A | | 10/1997 | Powell et al. | |
| 5,711,408 | A | | 1/1998 | Dick | |
| 5,722,815 | A | | 3/1998 | Cozens | |
| 5,794,657 | A | * | 8/1998 | Oberg | 137/543.19 |
| 6,067,963 | A | * | 5/2000 | Oi et al. | 123/458 |
| 6,352,067 | B1 | | 3/2002 | Genslak | |
| 6,877,525 | B2 | | 4/2005 | Fischer et al. | |
| 6,968,858 | B2 | * | 11/2005 | Kuehn et al. | 137/539.5 |
| 6,994,108 | B2 | * | 2/2006 | Roth et al. | 137/541 |
| 7,246,607 | B2 | * | 7/2007 | Burke et al. | 123/516 |
| 2003/0037822 | A1 | * | 2/2003 | Fischer et al. | 137/528 |

* cited by examiner

*Primary Examiner*—Stephen K. Cronin
*Assistant Examiner*—Arnold Castro
(74) *Attorney, Agent, or Firm*—Polser Lieder Woodruff & Lucchesi

(57) ABSTRACT

A high-pressure fuel pump (10) used in a fuel system includes an electric motor (14) having a drive shaft (16) to which is attached a pumping element (18). A fuel inlet passage allows low-pressure fuel to be drawn into the pump, and a fuel outlet passage (24) allows high-pressure fuel to be pumped to an internal combustion engine (E). A check valve assembly (30) is installed in the outlet passage and includes a check valve (36) which, when the pump is off, blocks an inlet (38) into the outlet passage to prevent fuel flow through the passage and into the pump resulting in a decrease in pressure in the fuel system. When the pump is operating, the check valve is forced away from the inlet to open the valve and allow fuel to freely flow through the passage. The fuel flows both around and through the check valve as it flows through the outlet passage. A retainer (32) seats against a shoulder adjacent an outlet end (44) of the outlet passage, and a spring (34) has one end which seats against the retainer and the other end of which seats against a base of the check valve. Flow of fuel around and through the check valve, when the valve is open, enables quiet operation of the check valve so when the pump is operating, there is no discernible noise or chattering from the check valve.

23 Claims, 4 Drawing Sheets

FUEL PUMP CHECK VALVE

CROSS REFERENCE TO RELATED APPLICATIONS

None

STATEMENT REGARDING FEDERALLY SPONSORED RESEARCH OR DEVELOPMENT

N/A

BACKGROUND OF THE INVENTION

This invention relates to electric fuel pumps, and more particularly to an improved check valve for such pumps which eliminates noise or chattering in the pump and reduces warranty returns caused by complaints of such chattering or noise.

As shown in the sectional view of FIG. 1, in one type of prior art electric fuel pump construction, a check valve V is installed in a fuel pump to prevent backflow of fuel into the pump and maintain the pressure in the fuel system of which the pump is a component. As shown in the FIG., the check valve includes a hemispherically shaped valve member B attached to a pintle or stem P for reciprocal movement through an outlet passage O of the pump. A spring S encloses the pintle and the resultant assembly is installed in the outlet of the pump during its fabrication. When the pump is in operation, the pintle is forced away from its seat and fuel flows around a sealing surface of the pintle and out of the pump. Ideally, fluid flow around the pintle stabilizes the pintle and keeps it relatively stationary due to the equalized forces surrounding it. In actuality, this does not happen. Rather, the forces are not equal for a variety of reasons and the result is that the pintle fluctuates from side-to-side in the outlet, producing a discernible noise or chatter.

A different prior art construction is shown in FIG. 2. Here, a check valve V' installed in the outlet passage O' of a fuel pump, comprises a ball and a spring S'. A seat Y is pressed into the inlet end of the outlet for the ball to seat against and seal the passage. When the pump is running, the ball is forced away from its seat against the force of the spring, and fuel flows around the ball, through the passage, and out of the pump. When the pump is shut off, the spring and fuel system pressure forces the ball back against its seat preventing backflow of fuel into the pump while maintaining fuel system pressure. As with the prior art check valve of FIG. 1, during pump operation, the ball member fluctuates about in the passage, again producing a discernible noise or chatter.

People driving vehicles in which one of these prior art fuel pumps is installed often attribute the valve related noise to a malfunctioning of the pump and seek replacement of the pump. This results in a warranty return that requires the pump manufacturer to replace the pump, usually at no cost to the vehicle manufacturer, and so increases the cost of the pump to the manufacturer.

BRIEF SUMMARY OF THE INVENTION

The present invention is directed to an improved check valve assembly construction which eliminates this chattering, thereby substantially reducing the number of warranty returns. An improved check valve assembly is installed in a fuel outlet passage of a fuel pump, a fuel module, or it is installed in-line. Fuel pumped through the outlet passage now flows around a sealing surface of the check valve and then through an open, base portion of the valve. This flow path stabilizes the valve and keeps it from rattling or chattering against the side of the passage making for a quieter operation. The base of the check valve has a flat rear surface for the base to sit flat against a retainer of the check valve assembly while the pump is operating. A spring used with the check valve is fully collapsible so the check valve sits flat against the retainer when the valve is open. When the pump is off, the spring and fuel system pressure forces the check valve against its seat for the sealing surface of the valve to seal against an inlet of the outlet passage to close off the passage to fuel flow.

Other objects and features will be in part apparent and in part pointed out hereinafter.

BRIEF DESCRIPTION OF THE SEVERAL VIEWS OF THE DRAWINGS

The objects of the invention are achieved as set forth in the illustrative embodiments shown in the drawings which form a part of the specification.

Corresponding reference characters indicate corresponding parts throughout the several views of the drawings.

DETAILED DESCRIPTION OF INVENTION

The following detailed description illustrates the invention by way of example and not by way of limitation. This description will clearly enable one skilled in the art to make and use the invention, and describes several embodiments, adaptations, variations, alternatives and uses of the invention, including what we presently believe is the best mode of carrying out the invention. As various changes could be made in the above constructions without departing from the scope of the invention, it is intended that all matter contained in the above description or shown in the accompanying drawings shall be interpreted as illustrative and not in a limiting sense.

Figure 8:
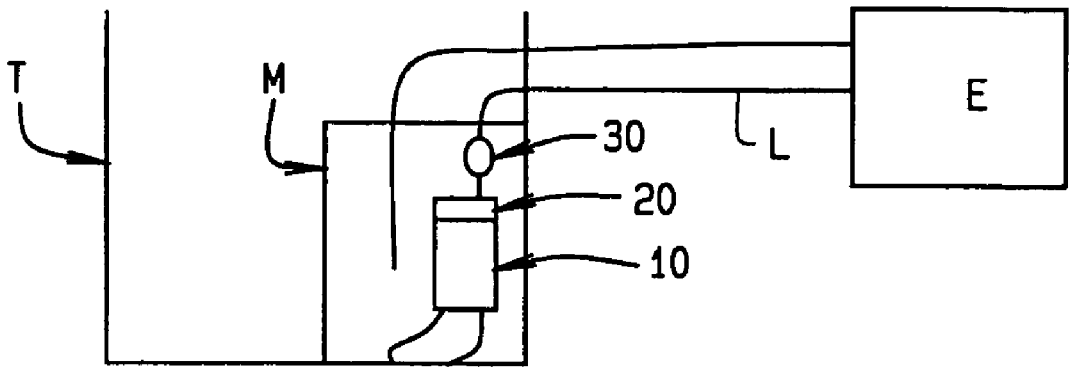
FIG. 8 is a simplified representation of the check valve assembly installed in a fuel module; and, FIG. 9 is a simplified representation of the check valve assembly installed in a fuel line.
Figure 9:
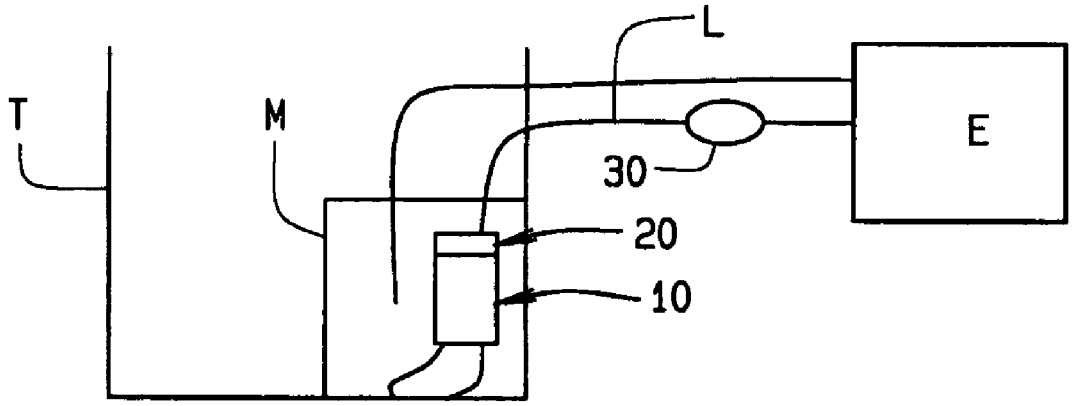

While the following description is with respect to the installation of an improved check valve assembly 30 into a fuel pump 10, those skilled in the art will appreciate that the assembly 30 can also be installed in a fuel module M as shown in FIG. 8, or in-line in a fuel line L as shown in FIG. 9.

Figure 1:
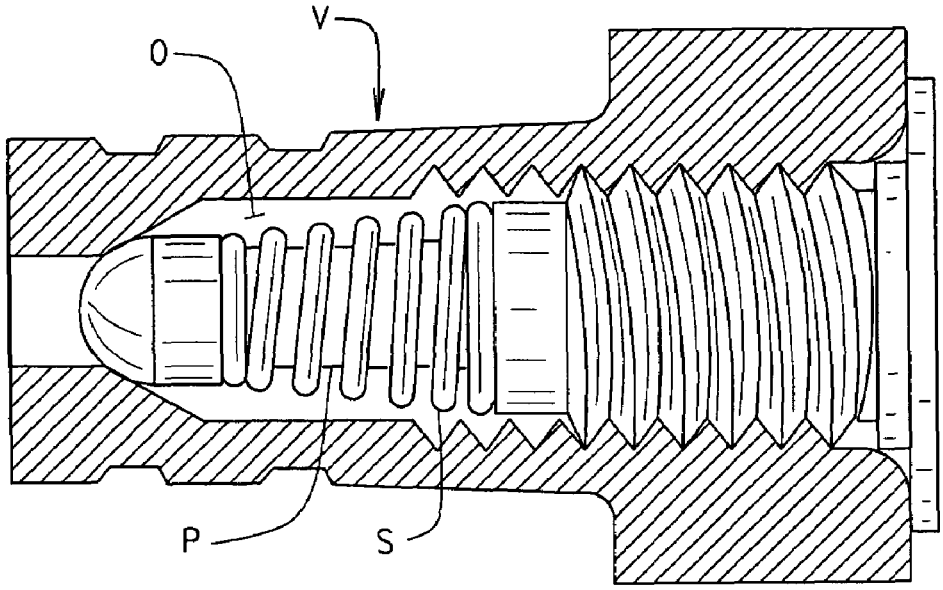
FIG. 1 PRIOR ART
FIG. 1 is a cross-sectional view of a prior art pintle and spring type check valve design.
Figure 2:
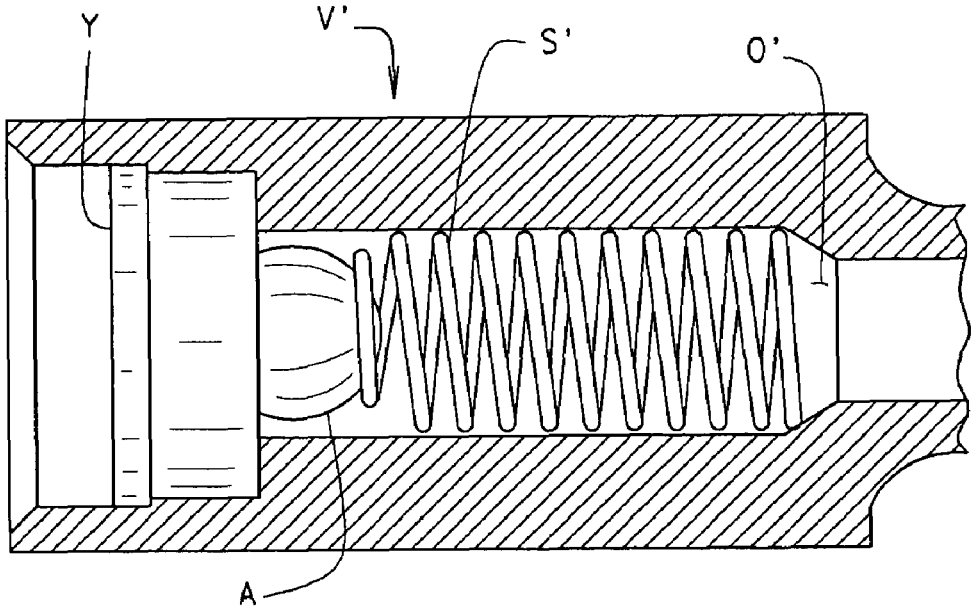
FIG. 2 PRIOR ART
FIG. 2 is a cross-sectional view of a prior art ball and spring type check valve design.
Figure 3A:
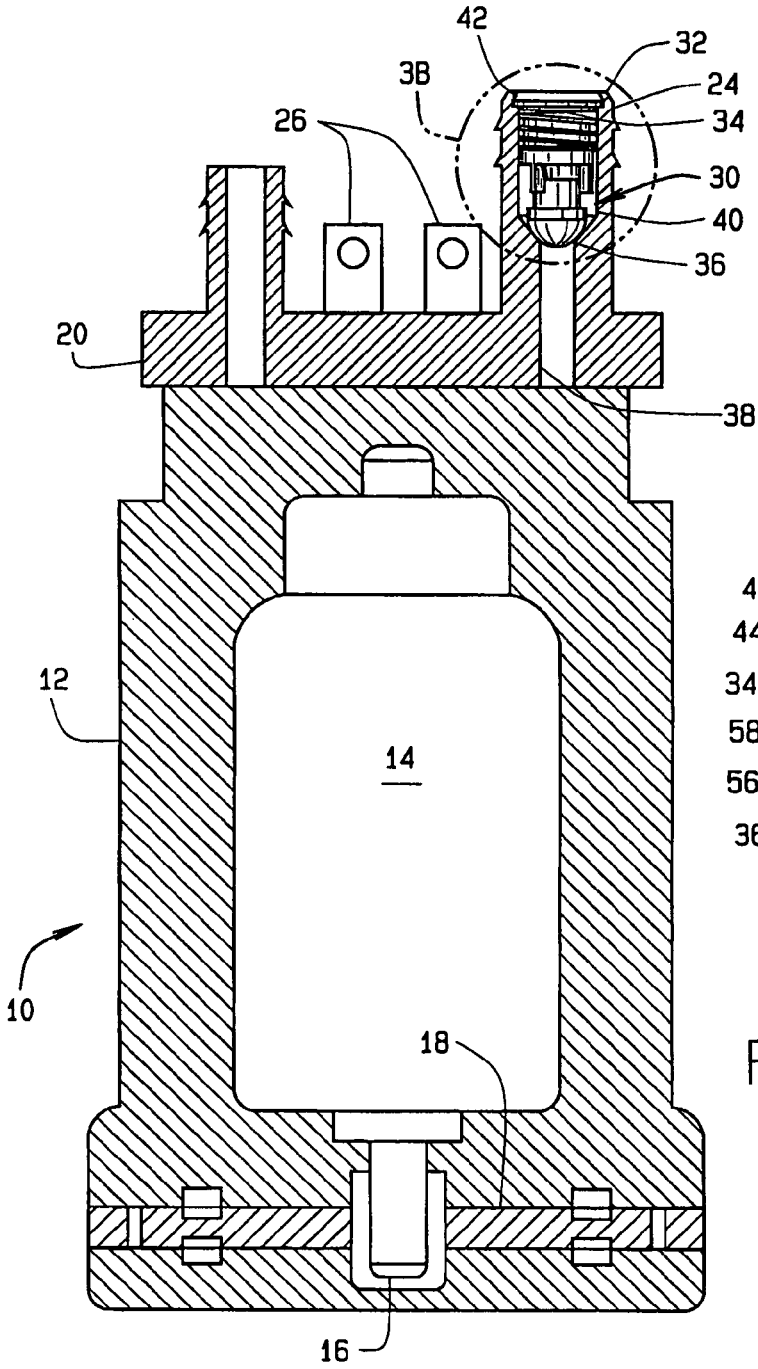
FIG. 3A is a cross-sectional view of a fuel pump in which a check valve of the present invention is installed in an outlet passage of the pump, the check valve being in its closed, pump-off position.

Referring to the drawings, FIG. 3A is a simplified representation of a high-pressure fuel pump 10 of the type used in automotive vehicles and the like. The pump includes a housing 12 in which is mounted an electric motor 14. Attached to a drive shaft 16 of the motor is a pumping element 18 which comprises, for example, an impeller. Fuel is drawn into the pump through an inlet passage (not shown). A cap 20 which fits onto one end of the pump assembly includes a fuel outlet passage 24, together with electrical connectors 26 for connecting motor 14 to a battery (not shown) or other source of electrical energy. The pump is typically installed in a fuel module M and the pump, when running, draws low pressure fuel from either a fuel tank T or from a fuel reservoir portion of the fuel module into the inlet passage. The fuel is then drawn into and through pumping element 18 and the resulting high pressure fuel is directed through outlet passage 24 to a fuel line L for delivery to an engine E. As is well-known in the art, any un-combusted fuel is returned from the engine to the fuel tank or to the reservoir portion of the fuel module.

A check valve assembly of the present invention, indicated generally 30, is installed in outlet passage 24 of the fuel pump. The check valve assembly functions to allow fuel to flow through the outlet passage when pump 10 is "on", to block flow of fuel back through passage 24 into the pump, when the fuel pump is "off", and maintain pressure in the fuel system between the pump and the engine when the pump is "off". Importantly, check valve assembly 30 is designed for quiet operation so that when fuel pump 10 is "on" and the check valve is open, no discernible noise or chattering is produced by the check valve.

Figure 3B:
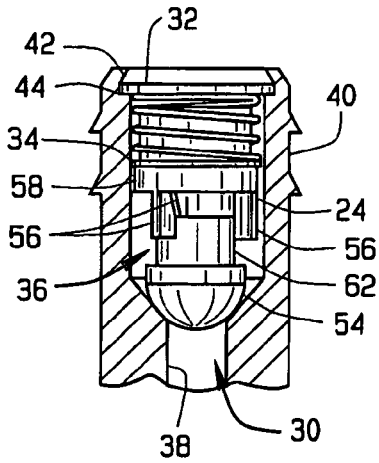
FIG. 3B is a cross-sectional view of a portion of the pump with the check valve being in its closed, pump-off position.
Figure 4:
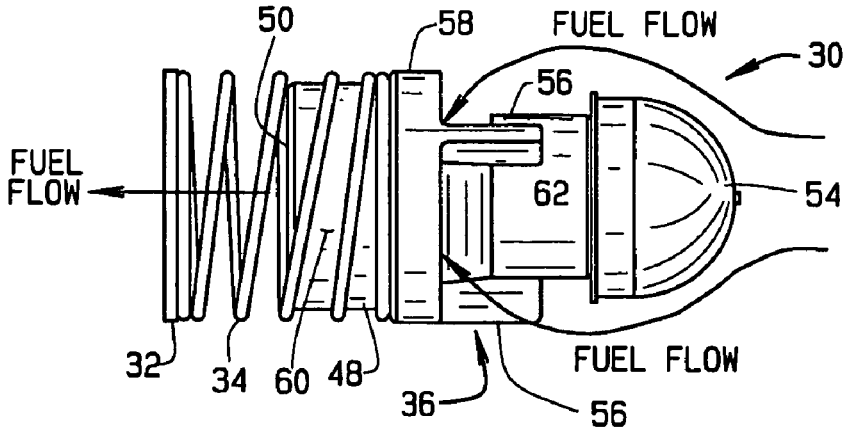
FIG. 4 is a side elevation view of the check valve assembly.

The check valve assembly comprises a retainer 32, a spring 34, and a check valve 36. As shown in FIGS. 3A and 3B, the section of outlet passage 24 in which assembly 30 is installed has an inlet 38 from the main body portion of fuel pump 10, a section 40 in which assembly 30 is installed, and a downstream section 42 from which fuel flows to the engine.

Figure 7:
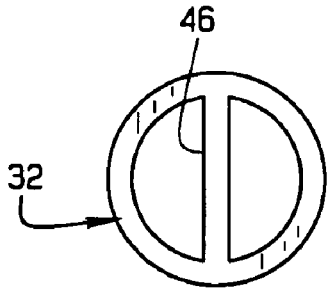
FIG. 7 is a plan view of a valve retainer portion of the assembly.

Retainer 32 comprises a circular ring whose outer diameter corresponds to the inner diameter of outlet passage section 42. The retainer fits against a shoulder 44 formed at the junction between sections 40 and 42. The retainer may be a metal ring or a plastic ring made of a material impervious to the fuel pumped by pump 10. As shown in FIG. 7, the retainer optionally can have a strut or bar 46 extending diagonally across the ring.

When assembly 30 is installed in section 40 of the outlet passage, one end of spring 34 seats against retainer 32 and the other end seats against a base 48 of check valve 36. Importantly, spring 34 is a fully collapsible spring so that when check valve 36 is fully opened, a rear surface (back end) 50 of the check valve seats against retainer 32. This facilitates full fuel flow around and through the check valve.

As noted, check valve 36 includes a base 48 whose rear surface 50 seats against a retainer 32 when the check valve is opened. The check valve further includes a sealing element 54 which is attached to base 48 by struts or legs 56 so that the sealing element is separated or spaced from the base along a longitudinal axis of the check valve. Sealing element 54 is a hemispherically shaped sealing element whose rounded outer end fits into inlet 38 of outlet passage 24 to seal the outlet passage when pump 10 is "off". It will be appreciated by those skilled in the art that element 54 can have other shapes (flat, conical, etc.) without departing from the scope of the invention.

Figure 5:
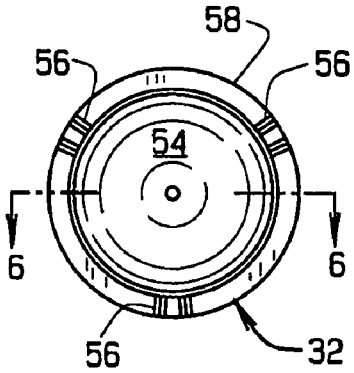
FIG. 5 is a front elevation view of the assembly.

Base 48 of the check valve comprises a hollow cylinder open at each end with the end adjacent sealing element 54 being spaced from the seating element so to define a fuel flow passage between the sealing element and base. Accordingly, when the check valve is open, fuel flows around the sealing element and through the base, and out of the outlet passage. There are three struts 56 extending between base 48 and sealing element 54, the struts being equidistantly spaced about the check valve as shown in FIG. 5. There could be more or fewer such struts without departing from the scope of the invention. A circumferential rim or shoulder 58 is formed at the end of base 48 adjacent the struts 56, this shoulder extending outwardly from an outer sidewall 60 of the base. One end of spring 34 seats against the underside of this shoulder and allows the movement of the check valve to fully collapse spring 34 when the check valve opens so the check valve seats against retainer 32.

Figure 6:
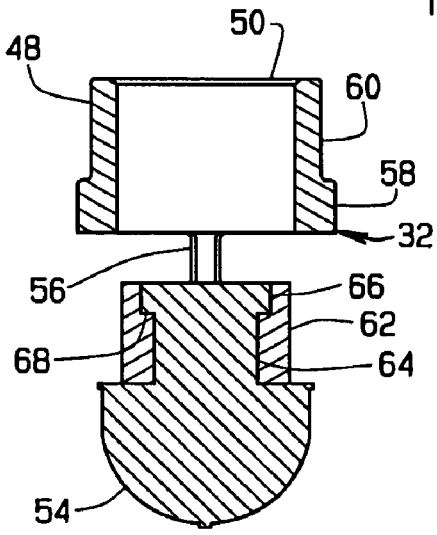
FIG. 6 is a sectional view of the check valve taken along line 6-6 in FIG. 5.

A collar 62 is connected to the other end of the struts. As shown in the sectional view of FIG. 6, sealing element 54 includes the hemispherical head which fits into inlet 38 of outlet passage 24, and a stem 64 which has an enlarged diameter section or rim 66 at its distal end. Sealing element 54 is attached to check valve 36 by pushing stem 64 into the collar until rim 66 snap fits into a circumferential notch 68 at one end of collar 62 so to form a unitary check valve construction.

In view of the above, it will be seen that the several objects and advantages of the present invention have been achieved and other advantageous results have been obtained.

The invention claimed is:

1. In a high-pressure fuel pump used in the fuel system of automotive vehicles, the pump including an electric motor a drive shaft of which is attached to a pumping element, a fuel inlet passage for low-pressure fuel from a source thereof to be drawn into the pump, a fuel outlet passage through which high-pressure fuel is pumped to an engine of the vehicle, and a check valve assembly installed in the outlet passage comprising:

a retainer seated at an outlet end of the outlet passage;

a check valve which, when the pump is off, blocks an inlet into the outlet passage to prevent fuel flow through the outlet passage and into the pump, resulting in a decrease in fuel pressure, but, when the pump is operating is forced away from the inlet to open the valve and allow fuel to freely flow through the outlet passage, the fuel flowing both around and through the check valve as it flows through the outlet passage with the flow of fuel around and through the check valve, when the check valve is open, providing for quiet operation of the fuel system so when the pump is operating no discernible noise or chattering is produced by the check valve; and, a spring one end of which seats against the retainer and the other end of which seats against the check valve, the spring being a fully collapsible spring by which, when the check valve is opened it collapses the spring sufficiently that one end of the check valve abuts against the retainer so that the outlet passage is fully opened.

2. The check vaive assembly of claim 1 in which the check valve includes a hollow base and a sealing element spaced from the base so to provide a fuel flow path around the sealing element and through the base when the check valve is open.

3. The check valve assembly of claim 2 in which the sealing element is a hemispherically shaped sealing element.

4. The check valve assembly of claim 3 in which the base comprises a hollow cylinder open at each end so when the check valve is open fuel flowing around the sealing element can flow through the base and out of the outlet passage.

5. The check valve assembly of claim 4 in which the check valve further includes at least one strut extending between the base and the sealing element to space them from each other.

6. The check valve assembly of claim 5 further including a plurality of struts extending between the base and the sealing element, the struts being equidistantly spaced about the check valve.

7. The check valve assembly of claim 4 in which the base has a shoulder formed at its end nearest the sealing element and extending outwardly from an outer sidewall of the base, the diameter of the shoulder being greater than the diameter of the remainder of the base so to form a seat for one end of the spring.

8. The check valve assembly of claim 5 further including a collar attached to one end of the strut and in which the seating element is fitted, there being a space between the base and the collar through which fuel flowing around the sealing element when the check valve is open can flow into and through the base of the check valve.

9. The check valve assembly of claim 1 further including a cap fitting onto one end of the fuel pump and including the fuel outlet passage and the check valve assembly.

10. A high-pressure automotive fuel pump comprising:

an electric motor including a drive shaft:

a fuel pumping element attached to the drive shaft;

an inlet passage by which low-pressure fuel from a source thereof is drawn into the pump;

a cap fitting onto one end of the fuel pump and including a pump outlet passage through which high-pressure fuel is pumped to an engine of the vehicle; and, a check valve assembly installed in the outlet passage, the assembly comprising a retainer seated at an outlet end of the outlet passage, a check valve which, when the pump is off, blocks an inlet into the outlet passage to prevent fuel flow through the outlet passage and into the pump resulting in a decrease in fuel pressure, but, when the pump is operating is forced away from the inlet to open the valve and allow fuel to freely flow through the outlet passage, the fuel flowing both around and through the check valve as it flows through the outlet passage with the flow of fuel around and through the check valve, when the valve is open, providing for quiet operation of the fuel system so when the pump is operating no discernible noise or chattering is produced by the check valve, and a spring one end of which seats against the retainer and the other end of which seats against the check valve, the spring being a fully collapsible spring by which, when the check valve is opened, the check valve collapses the spring sufficiently that one end of the check valve abuts against the retainer so that the outlet passage is fully opened.

11. The fuel pump of claim 10 in which the check valve includes a hollow base and a sealing element spaced from the base so to provide a fuel flow path around the sealing element and through the base when the check valve is open.

12. The fuel pump of claim 11 in which the sealing element is a hemispherically shaped sealing element.

13. The fuel pump of claim 12 in which the base comprises a hollow cylinder open at each end so when the check valve is open fuel flowing around the sealing element can flow through the base and out of the outlet passage.

14. The fuel pump of claim 13 in which the check valve further includes at least one leg extending between the base and the sealing element to space them from each other.

15. The fuel pump of claim 14 further including a plurality of legs extending between the base and the sealing element, the legs being equidistantly spaced about a perimeter of the check valve.

16. The fuel pump of claim 15 in which the base has a shoulder formed at its end nearest the sealing element and extending outwardly from an outer sidewall of the base, the diameter of the shoulder being greater than the diameter of the remainder of the base so to form a seat for one end of the spring.

17. The fuel pump of claim 14 further including a collar attached to one end of the leg and in which the sealing element is fitted, there being a space between the base and the collar through which fuel flowing around the sealing element when the check valve is open can flow into and through the base of the check valve.

18. A high-pressure automotive fuel pump comprising:

an electric motor including a drive shaft;

a fuel pumping element attached to the drive shaft;

a fuel inlet passage by which low-pressure fuel from a source thereof is drawn into the pump, and a fuel outlet passage through which high-pressure fuel is pumped to an engine of the vehicle;

a retainer seated at an outlet end of the outlet passage;

a check valve which, when the pump is off, blocks an inlet into the outlet passage to prevent fuel flow through the outlet passage and into the pump resulting in a decrease in fuel pressure in a fuel system in which the pump is installed, but, when the pump is operating is forced away from the inlet to open the valve and allow fuel to freely flow through the outlet passage, the check valve including a hollow base and a sealing element spaced from the base so to provide a fuel flow path around the sealing element and through the base when the check valve is open, and means for spacing the base and sealing element from each other to provide a fuel flow path around the sealing element and into the base; and, a spring one end of which seats against the retainer and the other end of which seats against the check valve, the flow of fuel around and through the check valve when the valve is open providing for quiet operation of the fuel system so when the pump is operating no discernible noise or chattering is produced by the check valve, the spring being a fully collapsible spring by which, when the check valve is opened, the check valve collapses the spring sufficiently that one end of the check valve abuts against the retainer so that the outlet passage is fully opened.

19. The fuel pump of claim 18 further including a cap fitting onto one end of the fuel pump and including the pump outlet passage.

20. The fuel pump of claim 18 in which the means for spacing includes at least one strut one end of which attaches to the base and the other end of which attaches to a collar which attaches to the sealing element.

21. In a fuel system having a fuel flow path through which fuel flows from a source thereof to a location where the fuel is combusted, a check valve assembly including a check valve having a closed position so, when fuel is not flowing through the path the check valve blocks the path to prevent fuel flow back through the path to the source, thereby preventing a decrease in fuel pressure in the fuel system, but, when fuel is flowing through the path is forced to an open position which allows fuel to freely flow through the path, the check valve assembly further including a hollow base and a sealing element spaced from the base so to provide a fuel flow path around the sealing element and through the base when the check valve is open, means for spacing the base and sealing element from each other to provide a fuel flow path around the sealing element and into the base, and a retainer and a spring one end of which seats against the retainer and the other end of which seats against the check valve, the spring being a fully collapsible spring by which, when the check valve is opened, the check valve collapses the spring sufficiently that one end of the check valve abuts against the retainer so that the outlet passage is fully opened, the flow of fuel around and through the check valve when the valve is open providing for quiet operation of the fuel system with no discernible noise or chattering being produced by the check valve.

22. The check valve assembly of claim 21 in which the source of fuel includes a fuel module and the assembly is installed in the module.

23. The check valve assembly of claim 21 in which the fuel system includes a fuel line extending between the fuel source and the location where the fuel is combusted, and the assembly is installed in the fuel line.

* * * * *